US005457617A

United States Patent [19]

Chan et al.

[11] Patent Number: 5,457,617

[45] Date of Patent: Oct. 10, 1995

[54] SLOPED RECESSED LIGHTING FIXTURE

[75] Inventors: Kingsley Chan, Guttenburg; Neil Russo, Howell; Andreas Pericleous, Colonia, all of N.J.

[73] Assignee: Lightolier Division of The Genlyte Group Incorporated, Secaucus, N.J.

[21] Appl. No.: 78,404

[22] Filed: Jun. 17, 1993

[51] Int. Cl.[6] ..... F21V 17/00

[52] U.S. Cl. ..... 362/366; 362/148; 362/287; 362/297; 362/365

[58] Field of Search ..... 362/364, 365, 362/366, 147, 148, 287, 427

[56] References Cited

U.S. PATENT DOCUMENTS

| | | | |
|---|---|---|---|
| 2,647,202 | 7/1953 | Elmer | 362/297 |
| 2,716,185 | 8/1955 | Burliuk et al. | 362/366 |
| 2,739,226 | 3/1956 | Rex | 362/297 |
| 3,381,123 | 4/1968 | Docimo | 362/366 |
| 4,039,822 | 8/1977 | Chan et al. . | |
| 4,086,480 | 4/1978 | Lahm . | |
| 4,408,262 | 10/1983 | Kusmer . | |
| 4,646,212 | 2/1987 | Florence . | |
| 4,729,080 | 3/1988 | Fremont et al. . | |
| 5,045,985 | 9/1991 | Russo et al. | 362/366 |
| 5,124,901 | 6/1992 | Sojka | 362/366 |
| 5,130,914 | 7/1992 | Bengochea | 362/365 |

FOREIGN PATENT DOCUMENTS

| | | | |
|---|---|---|---|
| 210406 | 2/1987 | European Pat. Off. | 362/297 |
| 156285 | 1/1921 | United Kingdom | 362/297 |
| 217861 | 6/1924 | United Kingdom | 362/297 |

*Primary Examiner*—James C. Yeung
*Assistant Examiner*—James C. Yeung
*Attorney, Agent, or Firm*—Hopgood, Calimafde, Kalil & Judlowe

[57] ABSTRACT

An improved optics, recessed lighting fixture specially designed for easy installation into sloped ceilings is described. The improved optics are provided by a novel asymmetrical dome reflector which adapts the fixture to sloped ceilings for directing reflected light to within the natural cone of illumination emitted by a lamp in the absence of a reflector.

5 Claims, 4 Drawing Sheets

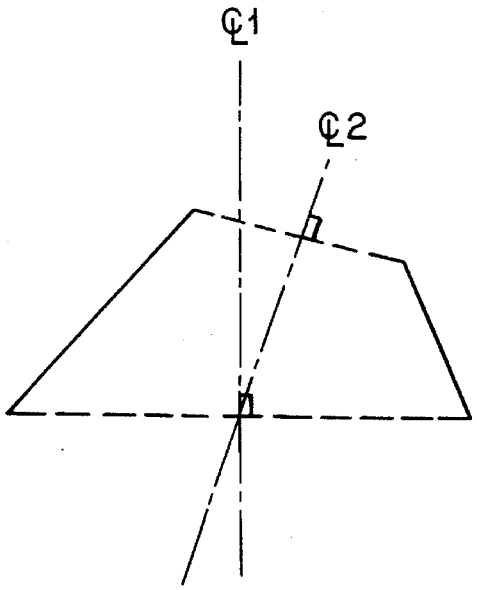
FIG. 3A
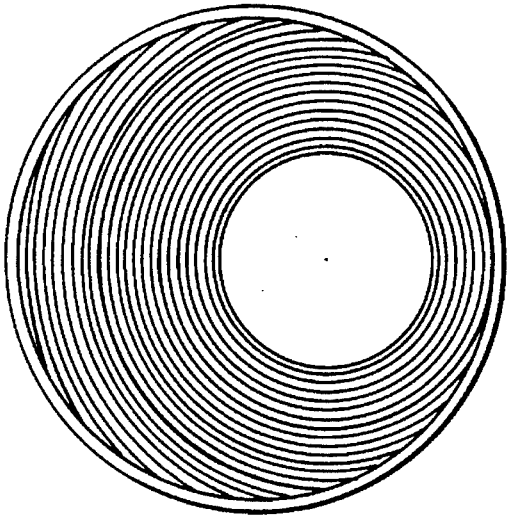
FIG. 3B
FIG. 4A
*PRIOR ART*
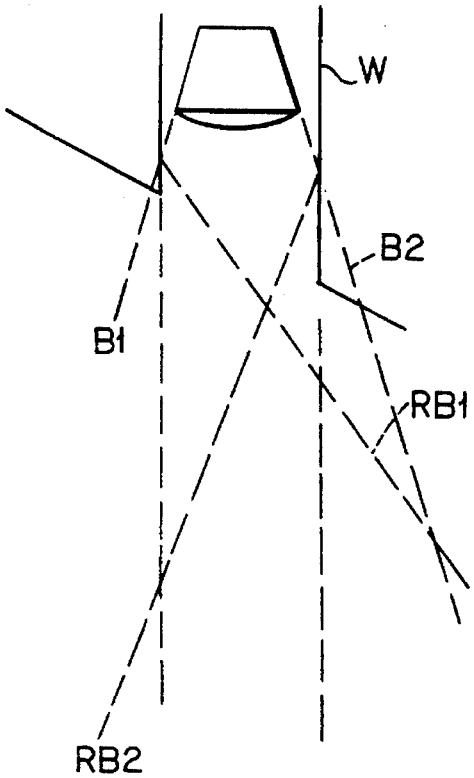
FIG. 4B
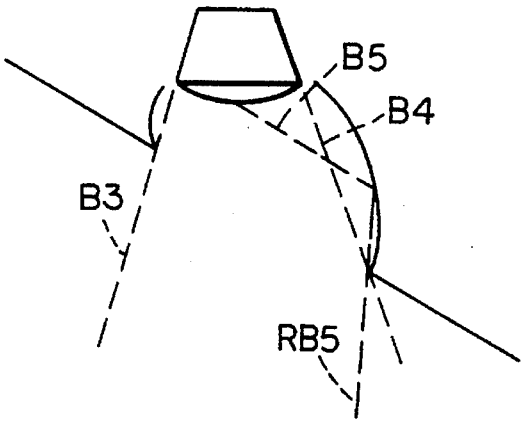

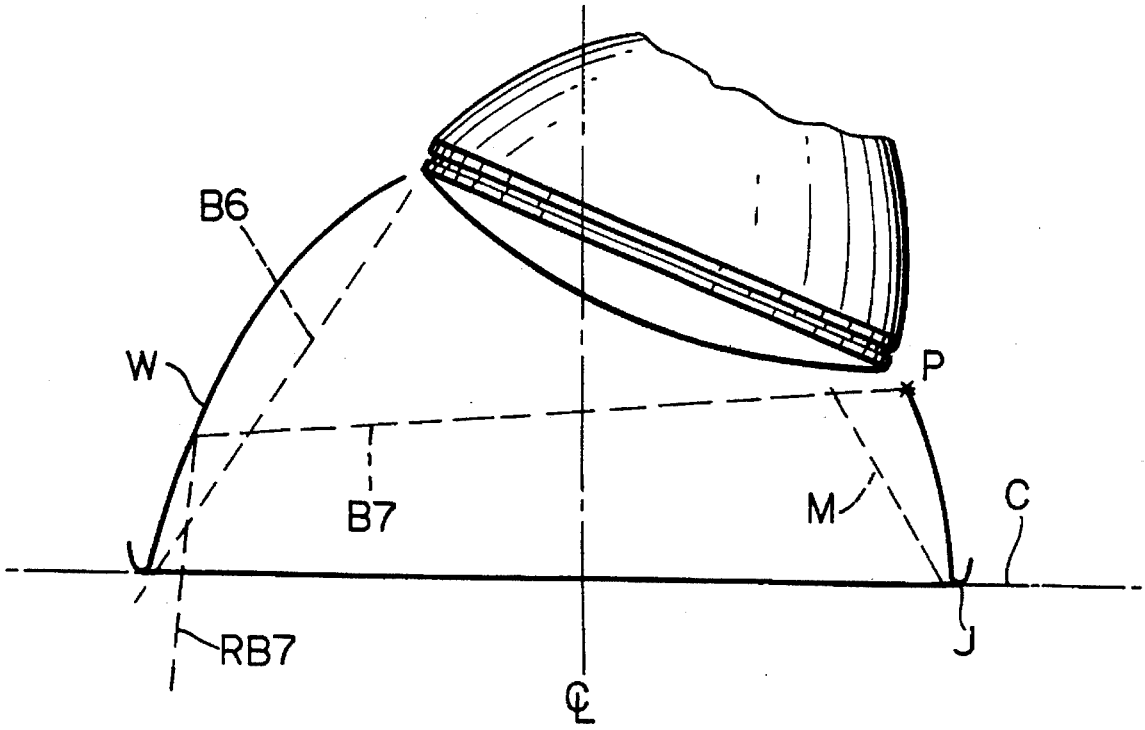
FIG. 5A
FIG. 5B
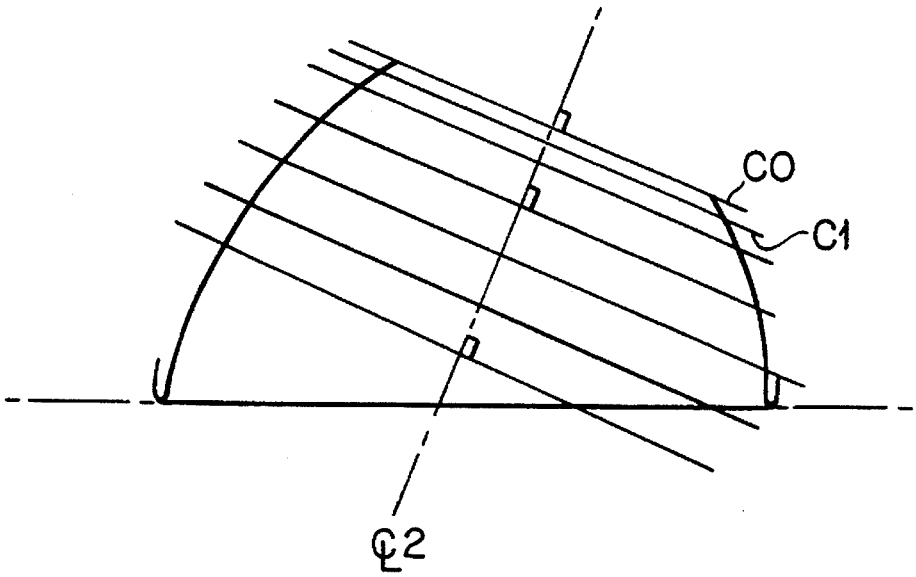

SLOPED RECESSED LIGHTING FIXTURE

BACKGROUND OF THE INVENTION

1. Field of the Invention.

This invention generally relates to recessed lighting fixtures for use in sloped ceilings, and to reflectors for use in such fixtures.

2. Description of the Related Art.

Recessed lighting fixtures have become commonplace for use in residential and commercial settings. Such settings typically have horizontal ceilings which allow for conventional installation of typical recessed lighting fixtures. However, certain architectural limitations or designs, including renovation of existing structures, may require that the ceiling be sloped, and manufacturers of recessed lighting fixtures have sought to devise lighting fixtures suitable for such use.

Known designs have typically been based on a standard recessed light fixture frame that is designed to be mounted horizontally, the bottom of the fixture including a hemispherical member which is adjustable or tiltable to the orientation approximate the slope of the ceiling. This type of design is typically used where the fixture is designed to have the lamp mounted vertically within it.

One variation of sloped ceiling recessed fixtures is described in U.S. Pat. No. 4,729,080. Generally, this fixture includes a frame designed to be mounted at approximately the slope of the ceiling and a cylindrical lamp housing which is attached to the frame and mounted vertically with respect to the floor. The cylindrical lamp housing includes a cylindrical reflector surface and has the lamp mounted therein vertically with respect to the floor. The orientation of the lamp may be adjusted within the housing to correct for different ceiling slopes. Yet other designs include a special adapter ring, or trim cut to match the slope of the ceiling.

Unfortunately, none of the above-described fixtures provide the kind of optical performance and cosmetic appearance that is desired for sloped ceilings. For instance, one drawback with such designs is the use of a generally cylindrical lamp housing and/or reflector. The intersection of this cylindrical geometry with the sloped plane of the ceiling effectively creates an elliptical opening in the ceiling (i.e. the ellipse as a conic section). Fabrication of an elliptical opening in a ceiling is not a conventional or easy operation, and poor positioning of the major and minor axes of the ellipse results in an undesirable cosmetic appearance.

Additionally, the movement of the lamp within the fixed cylindrical housing, such as described in U.S. Pat. No. 4,729,080, significantly alters the optics of the fixture, because the origin of the cone of illumination is moved while the reflector orientation remains fixed. In essence, some of the light from the lamp will be blocked by the housing, thereby creating undesirable shadows and other light beams may be focused at angles tending to cause halos around the reflector opening or at horizontal directions (which causes dispersal of undesired light beams at about eye level of people within rooms with such an arrangement).

Accordingly, there is a need for a recessed lighting fixture for sloped ceilings which provides improved optics and which is easier to install. In particular, it would be beneficial to provide such a fixture where the ceiling opening is circular rather than elliptical. It would also be advantageous to provide a recessed lighting fixture which has a reflector with improved optics designed for sloped ceilings.

OBJECTS OF THE INVENTION

It is an object of this invention to provide a recessed lighting fixture specifically designed for sloped ceilings which is easy to install.

Another object of this invention is to provide a recessed lighting fixture for sloped ceilings which has improved optics which are not compromised by installation or the geometry of the reflector. A more specific object of the present invention is to provide the desired optics even where the fixture is not installed parallel with the sloped ceiling.

Yet another object of this invention is to provide a fixture having adjustable optics for use with ceilings having variations in slope.

These and other objects will become apparent in the following description.

SUMMARY OF THE INVENTION

The present invention provides an improved reflector for use in recessed lighting fixtures, the reflector especially adapted for use in sloped ceilings. More particularly, the reflector comprises an asymmetrical dome having a continuous side wall, the top and bottom edges defining respectively a mouth and an illumination port, each of said mouth and illumination port being substantially circular, the planes in which the circular openings exist being intersecting (i.e., the axes of the circular openings are neither parallel nor colinear). As used herein, the term "substantially circular" defines a circle shape in which every point on the circle has a radius equi-distant from the center of the circle. In a particular embodiment, the continuous side wall of the asymmetric dome defines an arc from the mouth to the illumination port, the arc being characterized as a complex curve which varies axially along the continuous side wall. Most preferred is where the complex curve is designed to avoid bright images created by the reflector.

The recessed lighting fixture for sloped ceilings of the present invention comprises a frame for attachment to a ceiling structure. The frame has a plurality of depending side walls, a top wall, and a bottom member, with the bottom member having a circular opening. A housing is releasably attached to the frame and disposed in the opening in the bottom member, the housing having means for retaining and supporting a lamp. An asymmetrical dome reflector is releaseably attached to the housing for directing light from the lamp through a substantially circular illumination port.

The asymmetrical dome reflector comprises a continuous side wall, the wall having a first edge defining a substantially circular mouth and a second edge opposite the first edge, the second edge defining a substantially circular illumination port, such that the planes of the circular mouth and the circular illumination port are intersecting. In one embodiment, the continous side wall of the asymmetric dome has a smooth interior surface, while another embodiment has a series of concentric baffles.

BRIEF DESCRIPTION OF THE DRAWINGS

FIGS. 3A and 3B depict a cross-sectional view and a bottom view of an asymmetrical dome reflector according to this invention.

FIGS. 4A and 4B are cross-sectional views through a cylindrical reflector of the prior art and an asymmetrical dome reflector according to this invention, both as installed in a sloped ceiling, each figure also indicating optical characteristics of the respective reflector shown.

FIG. 5A depicts certain optics considered in the fabrication of an asymmetrical dome reflector, and FIG. 5B depicts graphically consideration in one method for manufacturing such a reflector.

DETAILED DESCRIPTION

The present invention is directed to recessed lighting fixtures and reflectors and associated housings therefor which are particularly useful for fixtures installed in sloped ceiling environments. The reflector and housing, including the lamp (bulb), can be installed in combination with a conventional recessed lighting fixture frame, such as described in the aforementioned U.S. Pat. No. 4,729,080, incorporated herein by reference.

Figure 1:
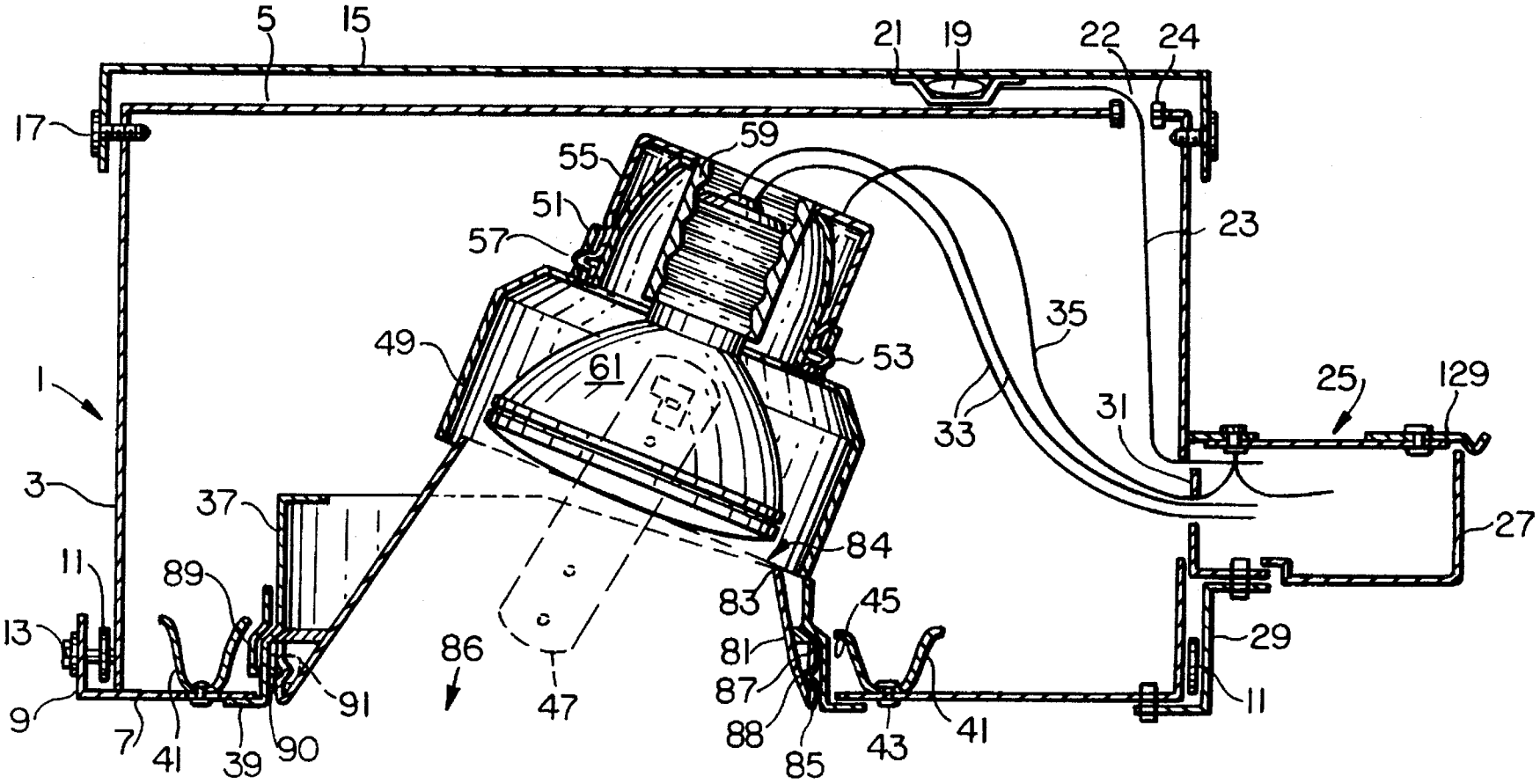
FIG. 1 depicts a cross-sectional view of a recessed lighting fixture according to this invention.

FIG. 1 depicts a recessed lighting fixture for use in a sloped ceiling according to this invention. The frame 1, which can be a conventional frame or one specially designed, is generally comprised of a box-type housing having depending side walls 3, an integral top wall 5, and a frame bottom 7. The frame bottom can be shaped (e.g., bent up and otherwise fabricated) to provide channel walls 9 for support bars 11, which can be adjustably attached to the frame by such means as screws 13. Support bars such as shown in U.S. Pat. No. 5,045,985, incorporated herein by reference, are preferred.

Over the top of the housing 1 can be placed a cover 15 secured to the housing by screws 17. Between the cover 15 and the top wall 5, a fuse 19 is provided; it is secured to the cover by means of a retaining bracket 21 attached to the cover 15. The top wall 5 includes a passage 22 through which wire 23 passes to electrically connect the fuse 19 to the electrical connections in junction box 25. A grommet 24 or similar type of protection is provided about the periphery of passage 22 to avoid damage to the insulation of wire 23.

The junction box 25 is generally a rectangular box and preferably includes a removable L-shaped door 27; the door is held in place by retaining clip 129. The junction box 25 is supported by and attached to the frame bottom 7 by a bracket 29. A space is provided between the bent-up portion of frame bottom 7 and the bracket 29 to accommodate a support bar 11. The junction box includes a back panel 31, also preferably removable, which includes passages for electrical wires 33 and ground wires 35 from the junction box into the fixture interior; the external wiring leading to the junction box from the power source is not shown in the figure.

The frame bottom 7 has a circular opening in which trim housing 37 is disposed. The trim housing is generally cylindrical in geometry and extends vertically below the plane of the frame bottom and then horizontally to provide an aesthetic trim 39, if such is desired; the trim may be eliminated depending upon the appearance desired. Trim housing retaining clips 41 are disposed circumferentially on the frame bottom 7 around the opening in the frame bottom into which the trim housing 37 is inserted and are rotatably attached thereto (e.g., using rivets 43). In this design for the retaining clips, each retaining clip includes a retaining tab 45 which frictionally engages the trim housing, as would a leaf spring, to removably secure the trim housing to the frame. The retaining clips may be rotated to allow for easier installation of the trim housing to the frame through the opening in the frame bottom (i.e., the clip and the associated tab can be rotated out of the way).

Figure 2A:
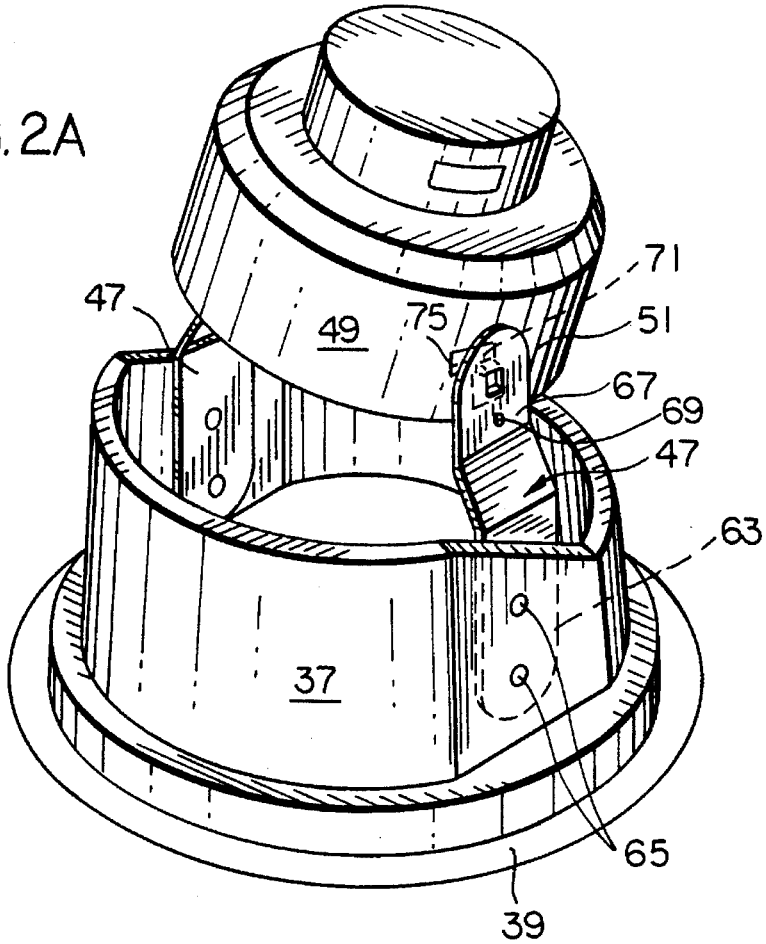
FIGS. 2A, 2B, and 2C depict, respectively, a more detailed view of the trim and neck housings of the fixture, a detail of one mechanism for angularly adjusting the neck housing with respect to the trim housing, and a cross-sectional view taken along line 2C—2C of that mechanism depicted.

Neck bracket 47, which is also shown in FIG. 2A, is secured to the trim housing 37 and connects the neck housing 49 to the trim housing by means which allows the neck housing to be angled with respect to the trim housing (as described below). Referring back to FIG. 1, the neck housing 49 is generally cylindrical with a top portion defining a rim for an opening, and a collar 51 disposed around the top portion. Spaced circumferentially about the collar are collar openings 53 by which socket cup 55 can be releasably attached to the neck housing. A suitable means for attaching the socket cup to the neck housing is by means such as leaf springs 57 secured within the socket cup; each leaf spring includes a protrusion designed to cooperate with a collar opening and which extends therethrough to secure the socket cup to the neck housing. Mounted in the socket cup 55 is a lamp socket 59 into which a bulb or lamp 61 can be retained and which is connected by the wiring to the junction box. Although shown as a typical screw-type bulb, the lamp may be of a fluorescent or other type lamp, and a suitable lamp socket receptacle will be chosen by the designer.

In general, the foregoing frame, trim housing, neck housing, and junction box can be any of those conventionally used to the extent they can be adapted to cooperate with the novel reflector of the present invention.

Figure 2B:
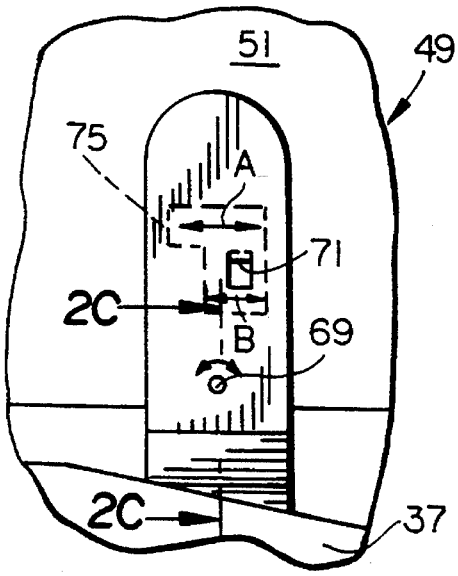
Figure 2C:
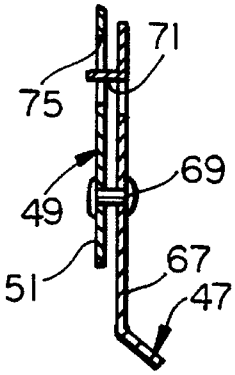

Nevertheless, a preferred trim housing is shown in more detail in FIGS. 2A, 2B, and 2C. As shown, trim housing 37 includes a bracket 47 having a lower end 63 attached to the trim housing, such as by rivets 65. The upper end 67 of bracket 47 is attached to the neck housing 49, preferably by means which allow the neck housing to be rotated or angled with respect to the trim housing. For example, the bracket 47 can be attached at its upper end 67 by a single rivet 69 acting as a pivot point (as shown by the arrow in FIG. 2B).

Although the neck housing can be attached to the trim housing in a fixed orientation, deviations from the ideal in the slope of the ceiling, or in the installation of the frame relative to the ceiling structure, may require minor adjustments to the illumination beam to create the desired lighting. To aid in positioning the neck housing in the proper orientation, a means is provided to limit the degree of rotation of the neck housing with respect to the trim housing. In a particular embodiment, shown in FIGS. 2B and 2C, a section of the upper portion 67 of the bracket can be partially stamped out and bent to form a tab 71. In a corresponding portion of the neck housing, a stop opening 75 is provided as an opening in the body of the neck housing through which the tab 71 extends. The rotation of the neck housing is limited by abutment of the tab against the edges of the stop opening as the neck housing is rotated about its point of attachment to the bracket (e.g., rivet 69). The stop opening can have an irregular geometry, as shown, wherein the freedom of rotation along double arrow A is greater than that along the path of double arrow B. Thus, the tab can be adjusted to coincide with either of these two paths of travel, depending upon the user's or designer's considerations.

Returning to FIG. 1, inserted through the bottom of the trim housing is an asymmetrical dome reflector 81 comprised of a continuous side wall having upper 83 and lower 85 edges, each of these edges respectively defining the plane of a circular opening designated as the mouth 84 or the illumination port 86 of the reflector. The bottom edge is preferably formed by rolling up a portion of the side wall to form a rim 87. This rim is further fabricated to include a groove 88 at various places around the circumference of the rim, and preferably around the entire circumference. This groove is concave with respect to the trim housing, and is a part of the preferred method of releasably securing the reflector to the trim housing, such as by means of retaining springs 89. These retaining springs are attached to the trim housing in a manner that will not interfere with installation of the reflector, and so are preferably disposed around the circumference of the trim housing. These particular retaining springs have a force directed towards the reflector, whereby the reflector is retained by engagement of the terminal portion 90 of the leaf spring 89 in the groove 88. The positioning of the reflector can be further assisted by means of lancet 91, an inwardly extending tab generally normal to the trim housing wall, and preferably formed by stamping out a portion of the side wall of the trim housing (as with the tab 71 in FIG. 2B used to control the extent of rotation of the neck housing).

In more particular detail to the embodiment shown in FIGS. 3A and 3B, the reflector is an asymmetrical dome having a mouth and an illumination port. As previously described, both of these openings (the mouth and the illumination port) are substantially circular in geometry. Shown in the cross-sectional view of FIG. 3A are the center lines ($c_1$ and $c_2$) for each of these circular openings. In this two-dimensional cross-section it can be seen that the axes for the two circular openings are neither colinear nor in the same plane, and the two planes of these two circles intersect when extrapolated. Taken further in view of FIG. 3B, a bottom view of the asymmetrical dome reflector, it is seen again that the axes for the circular openings are neither colinear nor in the same plane. Accordingly, while not readily apparent, the continuous side wall of the reflector is not symmetrical about the axis of either opening.

The primary consideration in the configuration of the asymmetrical dome reflector is to provide the most desirable optics. The shortcomings of the optics of currently available cylindrical reflectors are seen in FIG. 4A, in which certain lightbeams from the lamp (represented as dotted lines) are blocked by portions of the reflector. One drawback to such a design is that the light from the lamp is reflected by the reflector such that the light falls outside of the natural cone of illumination that would be given off by the lamp in the absence of a reflector. For example, lightbeams B1 and B2 from the lamp in FIG. 4A, which would define the natural cone of illumination, are reflected from the reflector as lightbeams RB1 and RB2, which cross the virtual lines W representing the vertical edges of the cylindrical reflector. It can be seen that the resulting cone of light using a cylindrical reflector is more diffuse than would be theoretically expected from the vertical sides of the reflector, and also is more diffuse and/or offset from the ideal cone of illumination than would be formed by lightbeams B1 and B2 in the absence of the reflector.

In contrast, as shown in FIG. 4B and in accordance with the present invention, the illumination port of the reflector is designed to just permit the exit of the edge lightbeams B3 and B4 without diversion by the reflector. Rather, lightbeams B3 and B4 are allowed to exit from the illumination port in a natural manner, as if the reflector were not present. Further, the reflector is designed such that other lightbeams, such as B5, are reflected (such as RB5) to be within the natural cone of illumination created by B3 and B4. The present invention thus does not waste light (or energy) by diffusing the light from the lamp, but instead redirects the light to be within the natural cone of illumination. By this method, because substantially all of the reflected light is directed to be within the natural cone of illumination, a greater apparent luminosity can be achieved with a lamp of the same luminosity (wattage) as would be present in the cylindrical reflector. By the same token, the same luminosity as would be produced with a cylindrical reflector can be produced by the present invention with the use of a lower power lamp.

While there are various methods for fabricating the asymmetrical dome reflector described, one method particularly preferred for the manufacture of reflectors for installation in sloped ceilings will be described with reference to FIG. 5A. A point P just adjacent the edge of the lamp is chosen as a point of illumination. Various lightbeams, such as B7, are taken as emanating from P and are directed to the opposing wall W of the reflector. The angle of wall W where B7 is incident is chosen to reflect the lightbeam both downwards and within the natural cone of illumination of the lamp, such as reflected lightbeam RB7. This procedure is repeated as necessary to arrive at the arcuate curve of wall W of a length practical for spanning from the lamp to the ceiling line C. Thereafter, the arc of wall W is rotated about centerline $c_1$ of the illumination port to produce a mirror-image arcuate curve M. However, it can be seen that, if symmetrical, a side wall of the reflector lying along curve M would shadow a portion of the light from the lamp. Curve M is thus rotated about point J, the intersection of curve M and the ceiling line C, until the curve lies on both the original point of illumination P and the junction point J. This procedure generates the largest distances between opposing walls of the reflector as well as the curve of each wall. It should be seen, then, that the curvature of the wall in a cross-section of the reflector (taken transversely to the mouth and the illumination port) will be a complex curve that varies as the plane of the cross-section is translated across the diameter of illumination port. However, manufacture of such a reflector requires a method which operates in three dimensions.

A preferred method according to the present invention for fabricating an asymmetrical dome reflector involves graphically generating a series of circles parallel with the circle defining the mouth of the reflector, the circle coincident with the mouth being labelled C0 in FIG. 5B. As such, moving along centerline CL2 a fixed increment (e.g., 0,009") defines the plane of the next circle, represented as line C1. The midpoint of line C1 (from the intersection of line C1 with each of the walls of the reflector) is taken as the center of that next incremental circle. It is important to note that the centers of the incremental circles at C0 and C1 are likely to be neither colinear nor parallel. This process of graphically and incrementally locating each of the circles is continued until the entire length of the reflector wall is considered. The result is a graphical representation of the geometry of the asymmetrical dome reflector. This graphical data can be used in combination with conventional numerical control (NC/CAD) machining systems to produce a male mold. It can be seen that the increments can be altered as desired to produce a series of baffles on the inner surface of the asymmetric dome with the desired distances between each baffle being determined by the increments, or, when minimized, to provide an essentially smooth surface. The baffles, thus created, are used in some situations where the placement of the lighting fixture could produce a bright glare. In such situations, the baffles "soften" the aesthetic appearance of the light from the fixture.

A metal sheet is then hydroformed (molded) over the male mold to produce a part having the desired asymmetrical dome geometry, and the part is finished by conventional techniques to produce the finished reflector as described above.

In practical applications, the ceiling environment may have a slight slope or a severe slope. Because it would be impractical to custom design and manufacture a reflector for each particular ceiling slope, it is preferable to provide a reflector which can be adjusted to accomodate a range of ceiling inclinations. The actual arcuate curves defined by the wall of the asymmetrical dome reflector are typically based on a design compromise. For various reasons, we have preferred to design the 14°–30° reflector based on a slope of about 23° (i.e., the angle between $c_2$ and the ceiling line C in FIG. 5A), and the 30°–45° reflector based on a slope of about 37° . Returning to FIG. 2B, the tab 71 is positioned to travel along the path of arrow A in the stop opening 75 for the 14°–30° reflector and along the path of arrow B for the 30°–45° reflector. This positioning allows the neck housing and the lamp therein to be adjusted to accomodate the actual ceiling slope.

It will be appreciated that one skilled in the art may vary the compromise design angle of slope and the degree of rotational adjustment of the neck housing and lamp to accomodate a desired spectrum of ceiling slopes. These and other modifications and changes to the invention as described herein may become apparent to one skilled in the art upon a review of this specification, such changes being within the scope and spirit of the invention as defined by the following claims.

What is claimed is:

1. A recessed lighting fixture for installation in a sloped ceiling environment, comprising:

a frame for attachment to a ceiling structure, said frame having a plurality of depending side walls, a top wall, and a bottom member, said bottom member having a circular opening;

a housing releasably attached to said frame and disposed in said opening in said bottom member, said housing having means for retaining and supporting a lamp; and an asymmetrical dome reflector adjustably attached to said housing for directing light from said lamp through a substantially circular illumination port, said asymmetrical dome reflector comprising a continuous side wall, said side wall having a first edge defining a substantially circular mouth opening and a second edge opposite said first edge, said second edge defining said illumination port; wherein the virtual planes defined by said mouth opening and said illumination port are not parallel; and wherein said continuous side wall has an outer surface and an inner surface, said inner surface having a series of baffles disposed thereon, said baffles defined by a series of circles parallel with said mouth opening.

2. The lighting fixture according to claim 1, wherein said lamp is angularly adjustable within said housing.

3. The lighting fixture according to claim 1, further comprising support bars for attaching said fixture to a ceiling structure.

4. An asymmetrical dome reflector for use in a recessed lighting fixture, comprising:

a) a continuous side wall;

b) said wall having a first edge defining a substantially circular mouth; and c) said wall having a second edge opposite said first edge, said second edge defining a substantially circular illumination port, such that the planes of said circular mouth and said circular illumination port are intersecting; wherein the axes of a first opening defined by said first edge of said circular mouth and the axes of a second opening defined by said second edge of said illumination port, are neither parallel nor colinear; wherein the geometry of said continuous side wall is defined by a series of circles parallel with said first opening of said circular mouth; and wherein the continuous side wall has an outer surface and an inner surface, said inner surface having a series of baffles disposed thereon, said baffles defined by said series of circles parallel with said first opening of said circular mouth.

5. A recessed lighting fixture for installation in a sloped ceiling environment, comprising:

a) a frame having means for attachment to a ceiling structure;

b) a housing disposed within said frame, said housing supporting a lamp; and c) an asymmetrical dome reflector disposed within said housing for directing light emanating from said lamp, said reflector having an illumination port through which light from said lamp emanates, said illumination port being substantially circular, and wherein said asymmetrical dome reflector comprises a continuous side wall with a first edge defining a substantially circular mouth and a second edge opposite said first edge, said second edge defining said illumination port, such that the planes of said circular mouth and said illumination port are intersecting.

* * * * *